United States Patent [19]

Franz et al.

[11] 3,939,637

[45] Feb. 24, 1976

[54] UNSTRETECHED POLYETHYLENE TEREPHTHALATE YARN IN CONTINUOUS STRETCHING AND FALSE TWIST TEXTURIZING PROCESSES

[75] Inventors: Günther Franz, Goggingen; Karl Heinrich, Bobingen; Herbert Poppe, Konigsbrunn, all of Germany

[73] Assignee: Hoechst Aktiengesellschaft, Frankfurt am Main, Germany

[22] Filed: Mar. 5, 1973

[21] Appl. No.: 338,312

[30] Foreign Application Priority Data

Mar. 11, 1972 Germany ..... 2211843

[52] U.S. Cl. ..... 57/140 R; 57/157 TS

[51] Int. Cl.[2] ..... D02G 1/02

[58] Field of Search ..... 57/140 R, 157 TS, 34 HS, 57/157 S

[56] References Cited

UNITED STATES PATENTS

| | | | |
|---|---|---|---|
| 3,435,603 | 4/1969 | Rice | 57/34 HS |
| 3,601,972 | 8/1971 | Rogers et al. | 57/157 TS |
| 3,708,970 | 1/1973 | MacFarlane | 57/140 R |

*Primary Examiner*—John Petrakes
*Attorney, Agent, or Firm*—Connolly and Hutz

[57] ABSTRACT

In known stretching and false twist texturizing processes for the manufacture of bulked yarn filaments of polyethylene terephthalate or of copolyesters of polyethylene terephthalate containing a preponderant proportion of polyethylene terephthalate structural units which are unstretched but have a degree of preorientation characterized by a natural stretching ratio of from about 1 : 2.7 to about 1 : 1.1 are used. The bulky yarns obtained do not have the high numbers of broken filaments and slubs hitherto observed and are distinguished by a uniformity of titer and an improved uniform dyeability.

4 Claims, 3 Drawing Figures

UNSTRETECHED POLYETHYLENE TEREPHTHALATE YARN IN CONTINUOUS STRETCHING AND FALSE TWIST TEXTURIZING PROCESSES

The present invention relates to the use of unstretched, pre-oriented polyethylene terephthalate filamentary yarn (PET yarn) for the manufacture of bulked yarns by continuous stretching and texturizing processes.

The development of texturized yarns is a result of the desire to adapt, by a suitable treatment, the properties of the originally smooth synthetic filament yarns to those of yarns of natural fibers. At present, the most important process for the manufacture of such voluminous yarns is the false twist process, which has developed from a discontinuous process with at least three stages into a continuous process.

Discontinuous processes are not only uneconomic, but also they cause disturbances and latent damages in the yarn, mainly by the traverse motion in winding up. Therefore, it has been quite obvious to perform the texturizing process continuously and, moreover, to connect it in series with the stretching process, as described for example in DOS No. 1,807,687. An amorphous synthetic yarn is passed into the channel of a stretching device the outlet of which is connected with the inlet of a texturizing device. Hence, a "stretch-texturizing" device of this type consists of at least three roller sets, the texturizing device and heating means each in the feeding zone and texturizing zone.

It is known that unstretched highly polymeric filaments generally can be stored for a short period of time only and under defined climatic conditions. In the stretching process the number of broken filaments rapidly increases if the filaments were stored for a prolonged period of time and under unsuitable climatic conditions. Consequently, the rapid ageing of unstretched highly polymeric filaments does not allow to use large bobbins, since, during the long running time of the said bobbins, for example on stretch-texturizing machines, ageing of filaments likewise manifests itself in an increase of broken filaments. The simultaneous starting of the three roller sets and the false twist texturizing device requires a considerable amount of time and hence, repeated starting owing to broken filaments impairs the econcomy of the stretch-texturizing process.

Another continuous stretching and texturizing process is described, for example, in British Pat. No. 777,625. In this "texturizing-stretching process" the unstretched yarn, after having passed a heating device, is fed by a roller set to a false twist texturizing device and drawn off by a second roller set at such a speed that the yarn is simultaneously texturized and stretched. The device required for continuously stretching and false twist texturizing can thus be simplified by using two roller sets, one heating element and the false twist texturizing device. It should be mentioned, however, that this surprisingly simple process has a number of disadvantages:

The texturizing tension, i.e., the tension of the yarn before it enters the texturizing machine cannot be freely chosen according the crimping characteristics of the texturized yarn; it is substantially defined by the stretching tension of the synthetic filaments (the expression "crimping characteristics" is taken from J. W. Lünenschloss , Pruefverfahren fuer texturierte synthetische Faeden, Melliand Textilberichte 7, 1971, pages 760 et seq.) The crimping characteristics improve in a wide temperature range with increasing setting temperature of the highly twisted yarn. In texturizing — stretching this temperature should not be too high since otherwise the still unstretched filament crystallizes in the unoriented state and then cannot be sufficiently stretched and texturized.

Attempts are made to obviate the aforesaid disadvantages by a texturizing-stretching process (U.S. Pat. No. 3,601,972) wherein the undrawn synthetic filament yarn is first drawn to less than full extent, and then texturized in the false twist crimping stage, and completely drawn. Like stretch-texturizing, this process again requires three roller sets and two heating elements and involves the known difficulties of attendance.

As in texturizing-stretching processes the same unstretched highly polymeric filaments are used; as in stretch-texturizing the same difficulties are encountered with respect to ageing of the unstretched filaments. Ageing may involve damage of the individual filaments also without filament breaking resulting in a poor appearance of the goods due to slubs (agglomerations of small filament pieces) or variations in titer. When the yarns are stretched in a highly twisted state, different stretching tensions obviously occur at the individual filaments, which results in a non uniform dyeability of the texturized yarn.

The pre-drawing step proposed in the aforesaid U.S. patent is unsuitable for polyethylene terephthalate filaments. If unstretched PET filaments are stretched below the natural stretching ratio, non uniform filaments are obtained in which unstretched segments alternate with stretched ones. Such filaments are unsuitable for further processing (cf. Ludewig, Polyesterfasern, Chemie und Technologie, Akademie-Verlag Berlin 1965, pages 197, 198, 212 and 215). If, however, the filaments are stretched in the pre-stretching stage beyond the natural stretching ratio, the process approaches more and more the stretch-texturing process described above.

It is the object of the present invention to produce voluminous bulked yarns having good crimping characteristics and textile properties from unstretched polyethylene terephthalate filaments by the known continuous stretching and false twist texturizing processes while obviating the difficulties hitherto observed, such as ageing of the unstretched filaments, high proportion of broken filaments, great number of slubs, non-uniformity of titer, and irregular dyeability.

This objective is obtained according to the invention by using in continuous stretching and false twist texturizing processes, unstretched polyethylene terephthalate filaments having a degree of pre-orientation characterized by a natural stretching ratio in the range of from 1 : 2.7 and about 1 : 1.1.

By unstretched PET filaments there are to be understood all PET filaments the technological data of which can be improved by a stretching process. The term PET filaments is intended to include filaments made of copolymers of polyethylene terephthalate in which the proportion of polyethylene terephthalate structural units predominates in the polymer molecule.

A range of pre-orientation is preferred which is characterized by a natural stretching ratio between 1 : 2.4 and 1 : 1.3, especially good results being obtained with a natural stretching ratio of from 1 : 2.0 to 1 : 1.4.

The natural stretching ratio can be defined by evaluation of the stress-strain diagrams of unstretched PET filaments.

Figure 3:
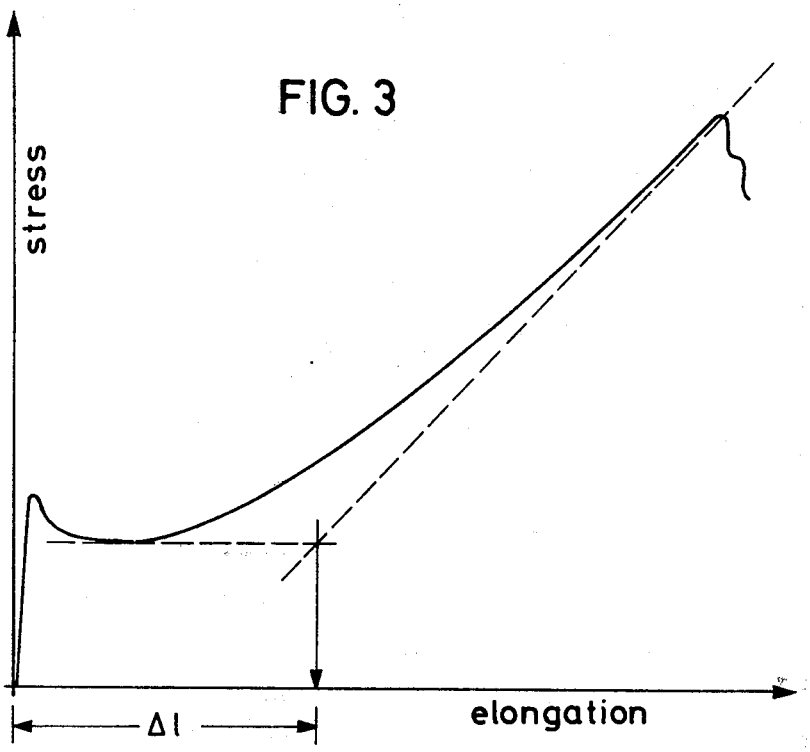
FIG. 3 is a graph of a typical stress-strain curve of unstretched filaments or yarns from polyethylene terephthalate.

The stress strain diagram is determined with filaments kept under defined climatic conditions, i.e., at a temperature of the ambient air of 20°C and with a relative atmospheric humidity of 65 %. The clamping length of the filament is 100 millimeters, the filament being under a slight pre-load of 0.05 g/dtex. With a constant drawing speed of 100 millimeters per minute the traction acting on the filament is determined. In FIG. 3 a typical stress strain diagram for unstretched PET filaments is shown. The natural stretching ratio is the ratio of the original length of the filament (clamping length $l_o$) to the length of the filament at the end of the yield zone ($l_o + \Delta l$). According to FIG. 3 the value of $\Delta$ l is determined as the point of intersection of the horizontal tangent in the yield zone with tangent on the stress-strain line before the breaking range.

To characterize the pre-orientation necessary according to the invention of the unstretched PET filaments other measurements may also be used, which may be more simple to determine with a high degree of pre-orientation. The measurement of the sound velocity, which may also be considered a value of the pre-orientation, is especially suitable. The range of the natural stretching ratio of about 1 : 2.7 to 1 : 1.1 according to the invention approximately corresponds to a range of sound velocity of 1,420 to 3,000 meters per second.

Alternatively, the degree of pre-orientation of a filament can be determined by the refraction or the shrinking tension. The required range of the natural stretching ratio of 1 : 2.7 to 1.: 1.1 approximately corresponds to a birefringence of from 0.015 to 0.125 or a shrinking tension of from 12 to 300 milligrams/dtex.

To determine the sound velocity the running time of a longitudinal sound impulse of a few milliseconds on a filament is measured under normal climatic conditions (20°C and 65% of relative humidity) at a filament tension of about 0.1 g/dtex. The measurement is effected, for example, by a dynamic modulus tester of Messrs. Morgan, Great Britain.

The refraction of unstretched filaments is determined according to the compensation method, as described, for example, in "Newer Methods of Polymer Characterization, " edited by Bacon Ke, Interscience Publishers, 1964, New York/Sidney/London, page 175.

The shrinking tension of unstretched PET filaments is determined in water of 80°C as follows: a filament is clamped between a stationary clamp and a force measuring head at a distance of about 200 millimeters. As measuring head an electronic pathless Tensotron measuring head is used (electronic tensiometer of Messrs. Rothschild, Switzerland). The clamped filament is immersed in the water of 80°C and within about 1 second it reaches the water temperature. The force acting at the measuring head is recorded as a function of time. The force drops suddenly when the filament is immersed and rapidly increases again immediately thereafter. It then reaches a maximum value and subsequently decreases slowly. This maximum force is defined as shrinking force, the shrinking tension is obtained by division by the filament titer.

Figure 1:
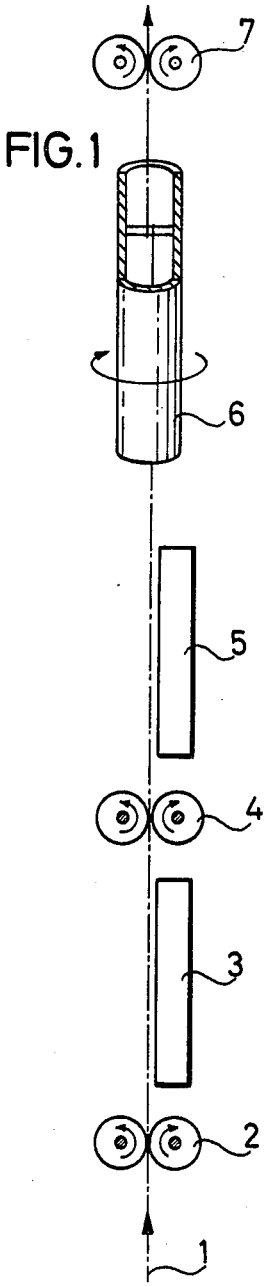
FIG. 1 is a schematic representation of a device for stretch-texturizing in accordance with the present invention.
Figure 2:
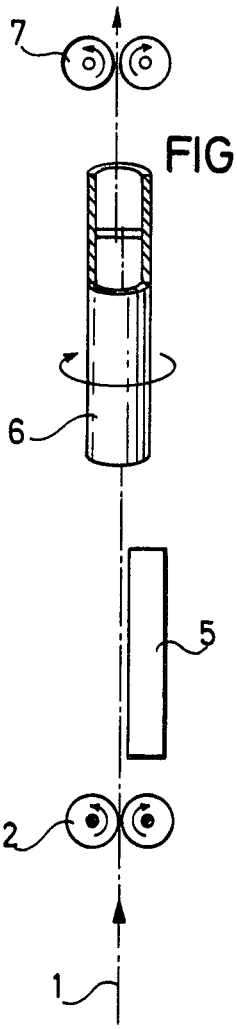
FIG. 2 is a schematic representation of a device for texturizing-stretching of unstretched filaments.

Suitable continuous stretching and false twist texturizing processes are all processes in which stretching and false twist texturizing are effected in one working stage without intermediate winding up, for example a stretch-texturizing process as shown in FIG. 1 of the accompanying drawing, in which in the most simple case an unstretched filamentary yarn 1 is stretched between two roller sets 2 and 4, optionally while heated by a heating element 3, and the stretch point possibly fixed by a pin. False twist texturizing is performed in the range between roller sets 4 and 7 by false twist texturizing device 6, the yarn being set by heating element 5. A further continuous stretching and false twist texturizing process is illustrated in FIG. 2 of the drawing, in which the unstretched yarn 1 is passed by a roller set 2 and heating element 5 and fed to false twist texturizing device 6. By means of roller set 7 the yarn is drawn off at such a speed that texturizing and stretching take place simultaneously.

Unstretched and pre-oriented PET filaments according to the invention can be used for continuous stretching and texturizing in all types of false twist texturizing processes. Depending on the machine equipment, there can be used, for example, preferably spindles, friction twisters or false twisters, as described in Belgian Pat. No. 745,825. The type of heating elements 3 and 5 according to FIG. 1 is not critical; for example contact heaters have also proved advantageous.

Polyethylene terephthalate filaments having the degree of pre-orientation as defined according to the invention are preferably obtained by spinning from the melt with a sufficiently high draw-off rate of the spun filaments. The minimum draw-off rate depends on the maximum value of the natural stretching ratio or optionally on the corresponding limiting values of the other measuring data specified for the pre-orientation.

If the natural stretching ratio is below about 1 : 1.1, filaments are obtained from which voluminous yarns having optimum properties cannot be produced by a continuous stretching or texturizing process. With increasing draw-off and winding-up rates the technical difficulties as to the control of the rapidly rotating masses increase. In most cases, extremely high rates of draw-off and winding-up are unsuitable in view of the desired high bobbin weights. The increase in the draw-off rate is also limited by economical considerations as — with a determined final titer of the yarn obtained — the mass output per unit of time in melt spinning does not increase in a linear manner with respect to the draw-off speed.

The advantages of the unstretched PET filaments with the specified pre-orientation in stretch-texturizing processes reside, in the first place, in the stability in storage of the said filaments. Even after a prolonged storage, without careful observation of the storing conditions, unstretched and pre-oriented filaments according to the invention yield, in a known continuous stretching and false twist texturizing process, texturized yarns of excellent uniformity, i.e., yarns which are characterized by a very low number of broken filaments and slubs and very uniform dyeing properties.

In the known false twist texturizing of stretched filaments optimum crimping characteristics of texturized yarns are obtained when defined numbers of revolutions of the spindles and a sufficient running speed of the filaments are maintained. When these conditions found by experience are used in the texturizing-stretching process unoriented filaments yield extremely slubby texturized yarns. This slubbiness can be partially avoided by an increased number of twists per unit-length, but with the same maximum number of revolutions of the spindle lower running speeds of the filaments are required. With the use of the unstretched and pre-oriented PET filaments according to the invention, the running speed can be the same as in the known false twist texturizing processes.

The main disadvantage of the texturizing-stretching process is the fact that the texturizing tension cannot be chosen so as to obtain yarns having optimum crimping characteristics, since the stretching tension of the unoriented filament must be exceeded. As compared therewith, the use of the pre-oriented and unstretched PET filaments according to the invention results in the following surprising advantage: when, in a device according to FIG. 2, the texturizing-stretching ratio is varied, i.e., the ratio of the speeds of roller sets 7 and 2, with otherwise unchanged settings, an optimum texturizing-stretching ratio is found at which the texturized yarns obtained have optimum crimping characteristics. These optimum crimping characteristics correspond at least to those obtained in the known discontinuous stretching and texturizing of the stretched yarns.

Surprisingly, the optimum texturizing-stretching ratio, found out for pre-oriented unstretched PET filaments according to the invention with the aid of the crimping characteristics, approximately corresponds to the texturizing-stretching ratio with which yarns of optimum strength are obtained. Also the uniformity of the yarn, expressed by the Uster value, is approximately at its optimum with this optimum texturizing-stretching ratio. The Uster value of a yarn corresponds to the variation coefficient of the mass of a bundle of filaments. It is determined by the Uster Uniformity Tester of Zellweger (Uster, Switzerland) (cf. Koch-Satlow "Grosses Textil-Lexikon" Deutsche Verlagsanstalt Stuttgart, 1966, page 543).

The optimum texturizing-stretching ratio is a little below the stretching ratio which yields in the known stretch-twisting a yarn of equal elongation. It should be pointed out, however, that a clear relation between these two stretching ratios does not exist.

Depending on the degree of pre-orientation, texturizing-stretching ratios of from 1 : 2.5 to 1 : 1.1 and preferably between 2.3 and 1.7 are found with the use of the pre-oriented unstretched PET filaments according to the invention.

In the known discontinuous false twist texturizing of stretched filaments one skilled in the art knows at which number of rotations of the false twist spindle at which draw-off speed of the yarn the desired crimping characteristics can be obtained. When use is made of these experiences in the texturizing-stretching process, i.e., with the same number of revolutions of the spindle the speed of roller set 7 is chosen in accordance with the experience, in general very slubby voluminous yarns are obtained. In order to obviate this deficiency, the number of twists per unit length of yarn should be increased, that is to say with a constant number of revolutions of the spindle the draw-off speed of the yarn has to be reduced. As compared therewith, with the use of the pre-oriented unstretched PET filaments according to the invention high running speeds likewise yield texturized yarns of unobjectionable quality.

The following examples illustrate the invention.

Examples

Dried granular terephthalates having a relative viscosity $\eta_{rel}$ of 1.815, determined at 25°C in 1 % solution in a solvent mixture of 3 parts by weight of phenol and 2 parts by weight of tetrachloroethane, were melted in an extruder and the melt was forced through spinnerets with 32 orifices. The filaments leaving the spinnerets were cooled in known manner by an air current, treated with a spinning preparation and wound up. The amount of molten polyethylene terephthalate forced per unit of time through one spinneret was chosen, in dependence on the winding speed, in such a manner that after stretching the spun filaments had a final titer of 167*f* 32 dtex.

The spun filaments wound up at different speeds had the following values: (spinning A for comparison)

| spinning | A | B | C | D |
|---|---|---|---|---|
| winding speed (m/min) | 1000 | 1800 | 2000 | 2600 |
| natural stretch ratio | 1:3.45 | 1:2.30 | 1:2.10 | 1:1.70 |
| sound velocity (m/sec) | 1400 | 1420 | 1440 | 1520 |
| double refraction ($.10^{-3}$) | 4.03 | 14.64 | 17.40 | 27.80 |
| shrinking tension (mg/dtex) | 8.25 | 18.9 | 21.8 | 32.2 |

The filaments obtained according to A to D were continuously stretched and false twist crimped in a stretch-texturizing device according to FIG. 1 and a texturizing-stretching device according to FIG. 2. The contact heating plates 5 had a length of 1.20 meters and the false twist spindles 6 were provided with sapphire bars as deflecting organs. The spindles turned at a speed of 380,000 to 445,000 revolutions per minute. The number of revolutions of the spindle was chosen in such a manner that the yarns to be texturized were false twisted 2,300 times per meter.

In the stretch-texturizing process according to FIG. 1 the false twist texturizing device was preceded by a further set of rollers 2. The unstretched filaments 1 were drawn off the bobbin at a rate $V_2$ by set of rollers 2, passed over a contact heater 3 (pin, wrapping angle 360°) maintained at 85°C and fed to roller set 4 having a circumferential speed $V_4$. Between the two roller sets the filaments were stretched, the stretching ratio applied being calculated from the ratio of the circumferential speeds $V_4 : V_2$. After having left roller set 4 the stretched filaments were fed to the false twist device and transported further with the aid of roller set 7 having a somewhat lower speed $V_7$ than $V_4$. The advance of roller set 4 over roller set 7 was calculated in percent from the circumferential speeds according to the formula $$\frac{V_4 - V_7}{V_4} \cdot 100 .$$

In the texturizing-stretching process according to FIG. 2 the spun filaments were drawn off by roller set 2 at a speed $v_2$ and passed through the texturizing device with the aid of roller set 7 at a speed $V_7$. The stretching ratio applied was calculated from the ratio of the speeds $V_7 : V_2$.

In the following table are summarized the working conditions and to characterize the bulked yarns obtained there are also indicated, besides the strength and elongation at break, the following crimping characteristics:

initial crimp $$C_1 = \frac{X_2 - X_1}{X_2} \cdot 100\ (\%)$$

residual crimp $$C_3 = \frac{X_2 - X_4}{X_2} \cdot 100\ (\%)$$

shrinkage in hot air of 130°C $$S_{130} = \frac{X_o - X_1}{X_o} \cdot 100\ (\%)$$

The values $X_o$, to $X_4$ necessary for the calculation of the respective data can be obtained by the following test: The yarns to be tested are wound up under a tension of 0.04 to 0.06 g/dtex to a rope of 11,100 dtex, which rope is loaded with a pre-load of 10 g for 11,000 dtex each. After 5 minutes the length of the rope is recorded ($X_o$). While maintaining the pre-load, the rope is treated for 5 minutes with hot air of 130°C and its length is measured again after cooling ($X_1$).

The value $X_2$ is obtained after having loaded the rope for 30 seconds with the main load of 1000 g for 11,100 dtex each, while $X_4$ is obtained after a permanent load of 7 kg for 11,100 dtex each for 30 seconds with subsequent recovery for 5 minutes under the preliminary load.

The number of thread slubs per 100 kilometer of yarn are a measurement of filament damages. Texturized yarns should have slub numbers below about 25 per 100 kilometer of yarn.

Each breakage of yarn necessitates a production stop and restart.

In the table, spinning A is included for the purpose of comparison.

TABLE

| Example No. | 1 | 2 | 3 | 4 | 5 | 6 | 7 | 8 | 9 | 10 | 11 | 12 |
|---|---|---|---|---|---|---|---|---|---|---|---|---|
| | stretch-texturizing | | | | | | texturizing-stretching | | | | | |
| spinning | A | B | C | C | D | D | A | B | C | C | D | D |
| stretching ratio 1: | 3.82 | 2.80 | 2.40 | 2.50 | 2.30 | 2.30 | 3.00 | 2.36 | 2.20 | 2.35 | 1.80 | 1.85 |
| advance of roller set 4 (rate of over feed (%) with respect to roller set 7) | 4 | 2 | 4 | 6 | 7 | 6 | — | — | — | — | — | — |
| setting temperature of heater 5 (°C) | 210 | 230 | 210 | 210 | 210 | 210 | 210 | 210 | 210 | 210 | 210 | 210 |
| circumferential speed of roller set 7 (m/min) | 164 | 164 | 164 | 194 | 164 | 194 | 164 | 164 | 164 | 194 | 164 | 194 |
| strength (g/tex) | 35.7 | 38.3 | 31.2 | 33.5 | 36.5 | 38.5 | 16.0 | 30.4 | 32.4 | 34.3 | 32.6 | 30.8 |
| elongation at break (%) | 24.5 | 24.0 | 29.7 | 27.4 | 21.5 | 20.1 | 22.3 | 37.3 | 38.9 | 37.5 | 38.8 | 34.6 |
| initial crimp $C_1$(%) | 50.0 | 52.2 | 59.3 | 50.0 | 53.3 | 48.0 | 51.3 | 55.3 | 52.6 | 47.5 | 57.5 | 52.8 |
| residual crimp $C_3$ (%) | 41.0 | 45.8 | 52.2 | 41.1 | 46.9 | 41.4 | 40.9 | 46.5 | 44.8 | 39.5 | 51.3 | 45.8 |
| shrinkage in hot air $S_{130}$ | 47.5 | 49.3 | 55.0 | 43.7 | 48.6 | 43.8 | 45.8 | 52.6 | 48.6 | 44.0 | 53.5 | 48.2 |
| number of slubs/100 km of yarn | <10 | <10 | <10 | <10 | <10 | <10 | >50 | 20–30 | <10 | <10 | <10 | <10 |
| number of yarn breakages per 100 kg of yarn | 15.4 | 10.8 | 9.3 | 9.3 | 0.6 | 0.6 | 5.9 | 5.1 | 4.8 | 4.8 | 1.4 | 1.4 |

Which is claimed is:

1. Improvement in continuous stretching and false twist texturizing processes for the manufacture of voluminous yarns from unstretched spun filaments of polyesters comprising at least preponderantly polyethylene terephthalate structural units, which comprises using unstretched but pre-oriented spun filaments having a degree of pre-orientation characterized by a natural stretching ratio of about 1:2.0 to about 1:1.4, feeding the said filaments to continuously working stretching and false twist texturizing devices, stretching the said yarns at a stretch ratio of about 1:2.3 to about 1:1.7, and winding up the texturized yarns obtained.

2. The process of claim 1, wherein the unstretched spun filaments having the defined degree of pre-orientation are continuously stretched between two roller sets and passed immediately thereafter, without intermediate winding up, to a continuously working false twist texturizing device.

3. The process of claim 1, wherein the unstretched spun filaments having the defined degree of pre-orientation, after having passed a heating device, are continuously fed over a roller set to the false twist producing means of a false twist texturizing device and drawn off by a second roller set at a speed such that texturizing and stretching are performed simultaneously.

4. Voluminous yarns of polyethylene terephthalate filaments or filaments of copolyesters preponderantly consisting of polyethylene terephthalate structural units obtained by the process of claim 1.

* * * * *